US005674425A

United States Patent [19]

Hong

[11] Patent Number: 5,674,425

[45] Date of Patent: Oct. 7, 1997

[54] CONVECTION MICROWAVE OVEN WITH APPARATUS FOR CONTROLLING THE FLOW OF COOLING AIR TO A COOKING CHAMBER

[75] Inventor: Seok Weon Hong, Suwon, Rep. of Korea

[73] Assignee: Samsung Electronics Co., Ltd., Suwon, Rep. of Korea

[21] Appl. No.: 647,601

[22] Filed: May 13, 1996

[30] Foreign Application Priority Data

Jun. 29, 1995 [KR] Rep. of Korea ..... 15359/1995 U

[51] Int. Cl.[6] ..... H05B 6/80

[52] U.S. Cl. ..... 219/681; 219/400; 219/757; 126/21 A

[58] Field of Search ..... 219/681, 682, 219/683, 684, 400, 757; 126/21 A

[56] References Cited

U.S. PATENT DOCUMENTS 4,591,683 5/1986 Eke ..... 219/681

4,705,928 11/1987 Nakanishi ..... 219/757

4,908,488 3/1990 Park ..... 219/681

4,940,869 7/1990 Scholtes et al. ..... 219/681

*Primary Examiner*—Philip H. Leung

*Attorney, Agent, or Firm*—Burns, Doane, Swecker & Mathis, L.L.P.

[57] ABSTRACT

An oven is capable of cooking food in a microwave mode or in a simultaneous microwave/convection mode. During the microwave cooking mode, a first fan blows outside cooling air through an electrical component compartment and then into a cooking chamber via through-holes formed in a partition wall separating the compartment from the cooking chamber. During the simultaneous microwave/convection cooking mode, cooling air is prevented from entering the cooking chamber via the through-holes by an air curtain established across the cooking chamber side of the through-holes. The air curtain is established by a second air circulator which blows heated air into the cooking chamber in a direction toward the through-holes.

5 Claims, 4 Drawing Sheets

CONVECTION MICROWAVE OVEN WITH APPARATUS FOR CONTROLLING THE FLOW OF COOLING AIR TO A COOKING CHAMBER

FIELD OF THE INVENTION

This invention relates to a convection microwave oven which can fulfill a convection cooking function utilizing hot air that is produced by a heater which circulates in a circular motion in a cooking chamber, or by cooking simultaneously by convention and microwaves emitted by a magnetron, and more particularly, to an apparatus for preventing the entry of cooling air into the cooling chamber during the simultaneous convection/microwave cooking.

BACKGROUND OF THE INVENTION

In general, a microwave oven is an electric oven which cooks foodstuffs utilizing friction heat which is generated while molecules of a foodstuff to be cooked are motivated by microwave energy and then moved at high speeds. Recently a convection microwave oven has been developed, which has a cooking function by radiant heat and convective heat produced by an electric heater and a fan, as well as the essential cooking function by the microwave energy. By such a convection microwave oven, not only are foodstuffs like meat and fish cook evenly and thoroughly to the center portions of their inside by microwave energy, but also their surfaces are slightly browned to create taste and to give a better appearance, by utilizing hot air. Of course, foodstuffs can be cooked either only by emitting microwaves like as in a conventional method, or only by blowing hot air.

FIGS. 4A and 4B show a conventional convection microwave oven that is disclosed in Japanese Utility Model Publication No. 4-74203, in which FIG. 4A illustrates the inside of a cooking chamber 11 and FIG. 4B illustrates the inside of an electrical component compartment 12. As shown in the figures, the convection microwave oven comprises a main body 10, which is divided into the cooking chamber 11 for cooking foodstuffs and the electrical component compartment 12, and a door 13 attached to the front side of the main body 10 to open and close the cooking chamber 11.

On the upper portion of the cooking chamber 11 there is provided an electric heater 14 for heating the inside of the cooking chamber 11 in the convection cooking mode, and on the bottom of the cooking chamber 11 there is provided a rotatable tray 15 for supporting the desired foodstuff to be cooked. A number of air-suction holes 17 are formed on the upper portion of one side wall 16, by which the cooking chamber 11 and the electrical component compartment 12 are divided from each other, in order to draw the outside air into the cooking chamber 11 through the electrical component compartment 12, and a number of air-discharge holes 19 are formed on the upper portion of the other side wall 18 in order to discharge the air to the outside. On the other hand, a number of air-suction holes 21 and air-discharge holes 22 are formed on the rear wall 20 of the cooking chamber 11 in order to form passages for the air in the cooking chamber 11 which is circulated by a fan (not shown) mounted in a space behind the cooking chamber 11 when operating in the convection cooking mode.

As shown in FIG. 4B, in the electrical component compartment 12 various electrical components such as a magnetron 23 and a high voltage transformer (not shown) are mounted to generate microwaves of high frequencies, and a cooling fan 24 and a guide duct 26 are also mounted to introduce the outside air into the compartment 12 and to guide the air toward outlets so as to cool the above components, respectively.

The air-suction holes 17, which are formed on the side wall 16 between the cooking chamber 11 and the electrical component compartment 12, introduce a portion of the outside air which is forced to flow by the cooling fan 24, to the cooking chamber 11 in order to eliminate vapor generated when cooking foodstuffs by microwave energy. However, these air-suction holes 17 must be blocked up when cooking foodstuffs by the electric heater 14, that is, in the convection cooking mode, because relatively cool air introduced through the air-suction holes 17 causes loss of heat. For this purpose, in a conventional convection microwave oven a damper 25 has been mounted in the electrical component compartment 12.

The damper 25 is arranged for covering the air-suction holes 17 with a driving means such as an electric motor (not shown) which swings the damper 25 in the direction of the right-left sides, so that it opens or closes the air-suction holes 17 depending on the cooking modes. For example, when a foodstuff is cooked by microwaves emitted from the magnetron 23, the damper 25 is kept in the opened state to direct the outside air to the cooking chamber 11 through the air-suction holes 17 by the cooling fan 24, because in the microwave cooking mode the foodstuffs are cooked regardless of the temperature of the air in the cooking chamber 11. Therefore, vapor generated during the cooking of the foodstuffs is discharged out of the chamber 11 through the air-discharge holes 19. On the other hand, in the convection cooking mode in which the foodstuffs are cooked by the operation of the electric motor 14 with or without the microwave energy for the purpose of enhancing taste and visual appearance of meat and fish, the damper 25 is swung shut to prevent inflow of the outside air to the cooking chamber 11 in order that the air in the cooking chamber 11 can be maintained at a high temperature.

Accordingly, not only are the foodstuffs cooked evenly and thoroughly by microwave energy, but also their surfaces are browned to create taste and to have a better appearance by hot air-heating utilizing the electric heater 14 and a fan (not shown).

However, such a conventional convection microwave oven requires the damper 25 for closing the air-suction holes 17, and also driving and control means for operating the damper 25, and as a result the structure of the convection microwave oven is more complicated, and so it slows the assembling work on the production line. It also causes an increase of weight to the product while increasing cost.

SUMMARY OF THE INVENTION

An object of this invention is to provide a convection microwave oven in which in the convection cooking mode an air curtain is made by the hot air circulating in a cooking chamber so as to prevent outside cooling air from entering cooking chamber through air-inflow holes, thereby both enhancing the cooking efficiency and simplifying the structure of a convection microwave oven.

This invention, to accomplish the above object, comprises a main body including a cooking chamber and an electrical component compartment; a cooling fan for cooling a magnetron and a high voltage transformer mounted in the electrical component compartment; a number of air-inflow holes formed on one side wall partitioned between the cooking chamber and the electrical component compartment to draw the outside air into the cooking chamber; an electric heater which is arranged behind the cooking chamber and operates to heat the air in the cooking chamber in a convection cooking mode; and a hot air discharging means arranged in such a manner that hot air generated by the electric heater is discharged toward the air-inflow holes in order to prevent inflow of the outside air into the cooking chamber as well as to cook foodstuffs utilizing the circulating hot air.

The hot air discharging means includes a motor and a connecting shaft, a bracket supporting the motor, and a fan connected to one end of the connecting shaft.

By such a construction, the hot air, generated by the electric heater in the convection cooking mode, is discharged by the fan toward the air-inflow holes, thereby forming an air curtain for preventing the outside air from entering the cooking chamber.

Further, a guide duct having a bypass passage is mounted in the electrical component compartment. The guide duct directs the outside air to the air-inflow holes effectively in the microwave cooking mode while the guided outside air passes through the bypass passage in the convection cooking mode.

BRIEF DESCRIPTION OF THE DRAWINGS

In the accompanying drawings:

FIGS. 4A and 4B illustrate a conventional convection microwave oven in which FIG. 4A is a front view showing the inside of a cooking chamber and FIG. 4B is a partial transverse sectional view showing the inside of an electrical component compartment.

DESCRIPTION OF THE PREFERRED EMBODIMENT

A preferred embodiment of this invention will be described below, in detail, referring to the attached drawings.

Figure 1:
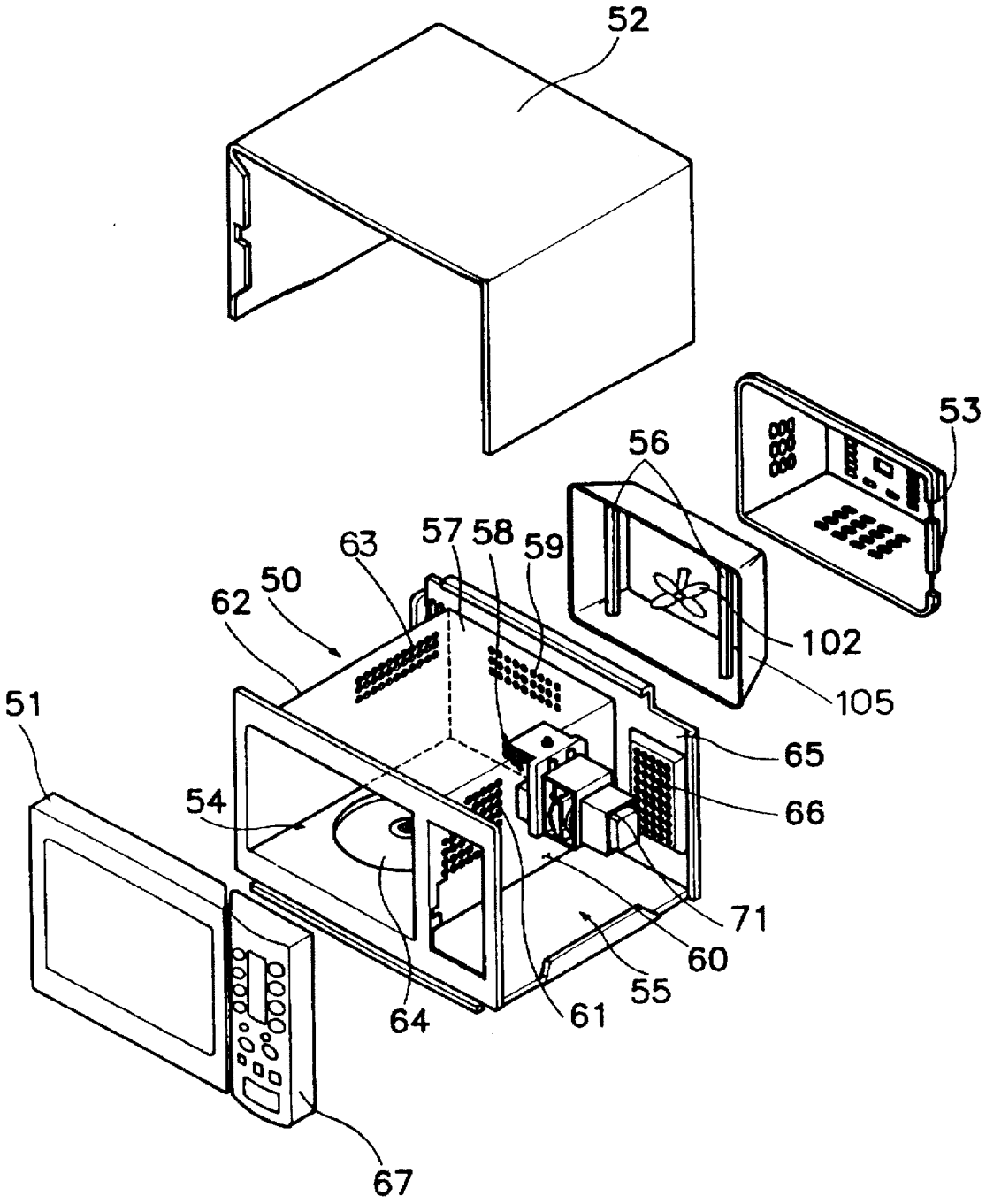
FIG. 1 is an exploded perspective view of a convection microwave oven according to this invention.

FIG. 1 is an exploded perspective view showing air passages of the convection microwave oven according to this invention. As shown in the figure, a convection microwave oven according to this invention comprises a main body 50 providing a space for cooking foodstuffs, a door 51 mounted on the front of the main body 50, an upper case 52 jointed to the main body 50 for forming an external appearance, and a protecting cover 53 mounted on the back side of the main body 50. The main body 50 is divided into a cooking chamber 54 and an electrical component compartment 55 next to the cooking chamber 54. Mounted in a space formed between the protecting cover 53 and a rear wall 57 of the cooking chamber is an electric heater 56 for emitting convective heat and radiant heat in the convection cooking mode, a hot air discharging means 100 for forcing the circulation of the hot air generated by the electric heater 56, through the cooking chamber 54, a supporting plate 105 for supporting the electric heater 56 and a hot air circulator or discharging means 100.

A number of hot air-suction holes 58 and hot air-discharge holes 59 are formed on the rear wall 57 of the cooking chamber 54 for providing air passages for circulating the air between the cooking chamber 54 and the hot air discharging means 100. In order to eliminate the vapor generated in the cooking chamber 54 in the microwave cooking mode, a number of air-inflow holes 61 are formed on one side wall 60 of the cooking chamber 54, and a number of air-discharge holes 63 are formed on the other side wall 62, as in a conventional convection microwave oven. On the bottom of the cooking chamber 54 there is provided a tray 64 for placing a foodstuff to be cooked.

A number of outside air-suction holes 66 are provided on a rear wall 65 of the electrical component compartment 55, and a control panel 67 is mounted on the front of the electrical component compartment 55. By the operation of an air circulator in the form of a cooling fan 68 (FIG. 2) that will be described hereinafter, an air stream route is formed such that the outside air is directed to the electrical component compartment 55 through the outside air-suction holes 66, and later is discharged outside through the air-discharge holes 63 of the cooking chamber 54 after entering the cooking chamber 54 through the air-inflow holes 61.

Figure 2:
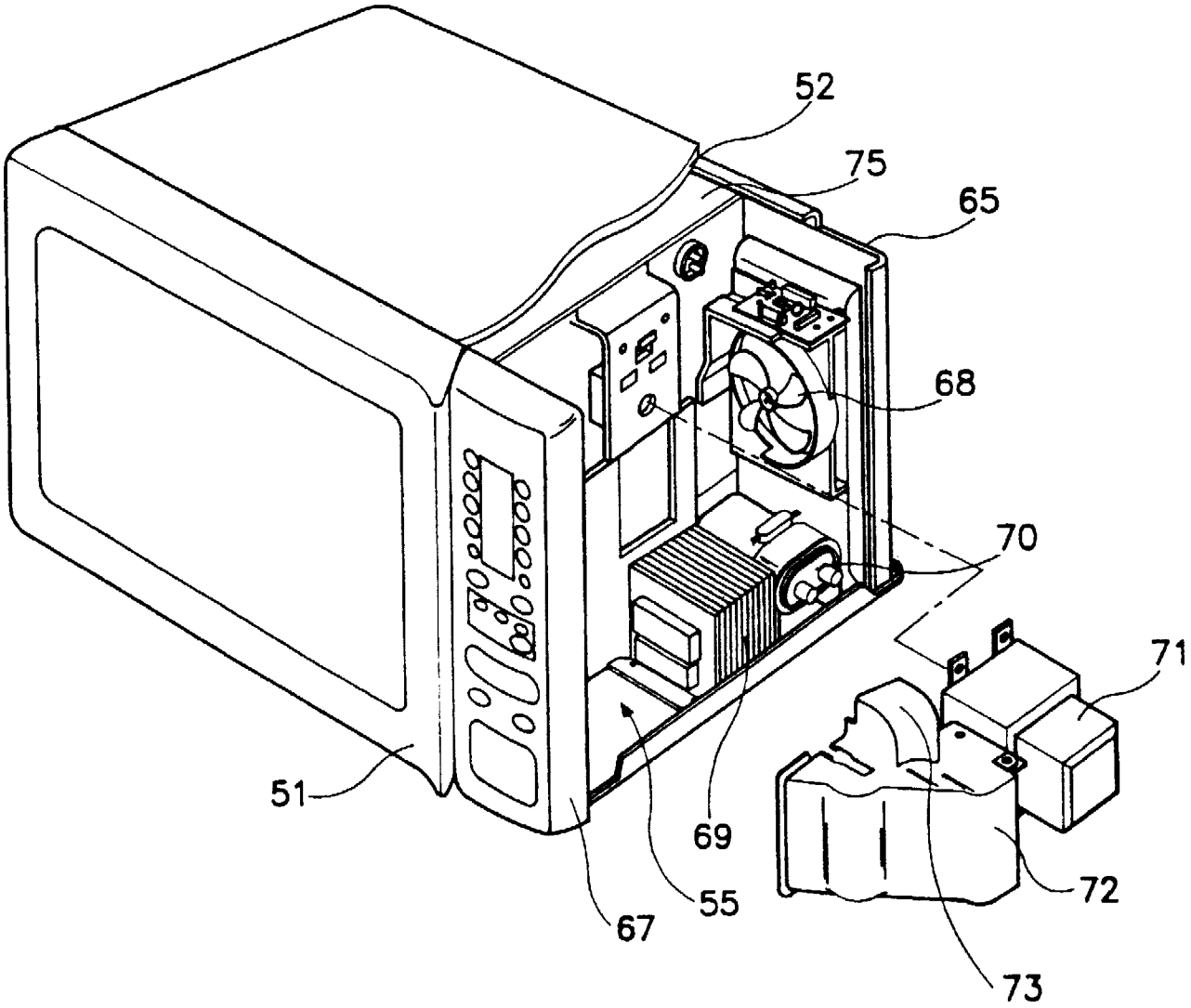
FIG. 2 is a perspective view showing the inside structure of the electrical component compartment in the convection microwave oven of FIG. 1.

FIG. 2 shows various electrical components in the electrical component compartment 55. As shown in the figure, in the electrical component compartment 55 there are mounted a high voltage transformer 69, a high voltage capacitor 70, and a magnetron 71, for creating microwaves and emitting them to the cooking chamber 54. On the front side of the outside air-suction holes 66 (FIG. 1), formed on the rear wall 65 of the electrical component compartment 55, there is mounted the cooling fan 68 for cooling the above electrical components 69,70,71. Further, in order to direct the outside air to the cooking chamber 54 during the operation of the cooling fan 68, a guide duct 72 is mounted in the electrical component compartment 55, one end of which is communicated with a number of the air-inflow holes 61 (FIG. 1) for conducting the outside air into the cooking chamber 54, and the other end of which is opened toward the cooling fan 68. A bypass passage 73 is formed on the upper portion of the guide duct 72 to conduct a portion of the outside air entering the guide duct 72. The air passing through the bypass passage 73 flows away to the outside through a space 75 between the top end of the main body 50 and the upper case 52 and thus bypasses the air-inflow holes 6. Instead of the bypass passage 73, a large opening or a number of holes may be formed on the upper portion of the guide duct 72 to conduct the outside air.

Figure 3:
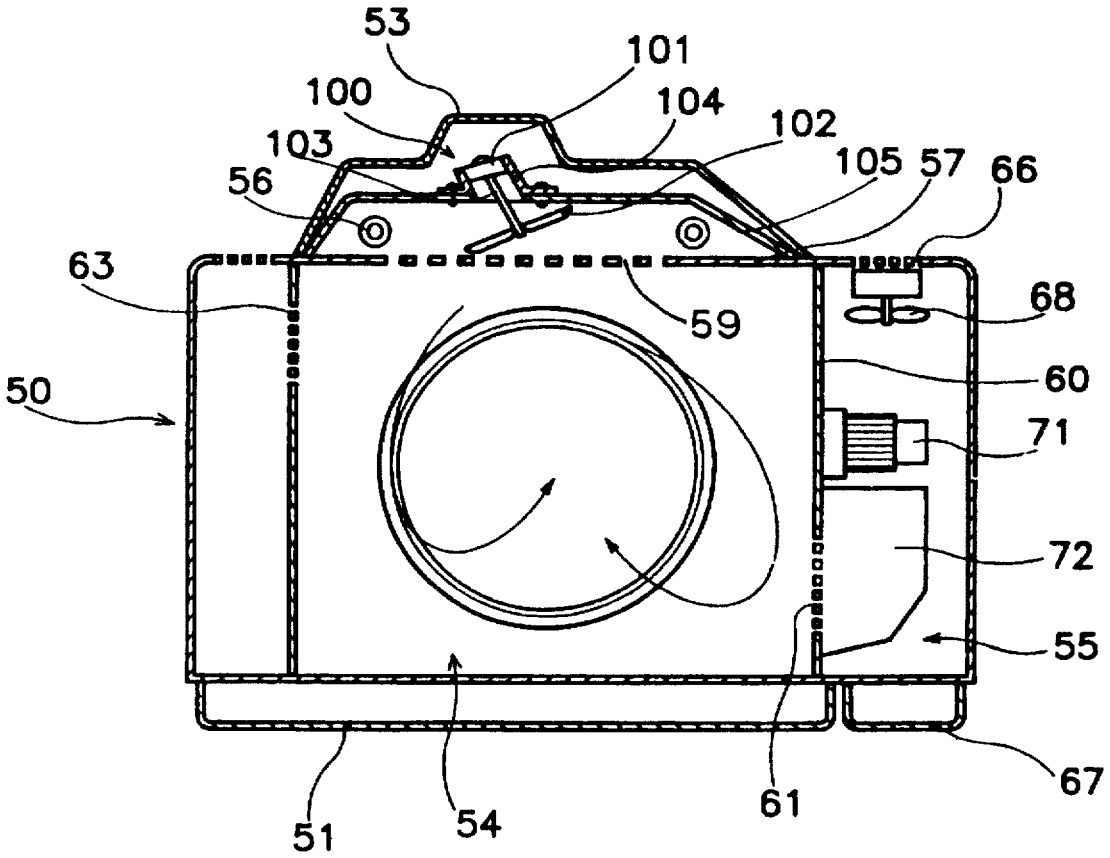
FIG. 3 is a transverse sectional view through the oven of FIG. 1.
Figure 4A:
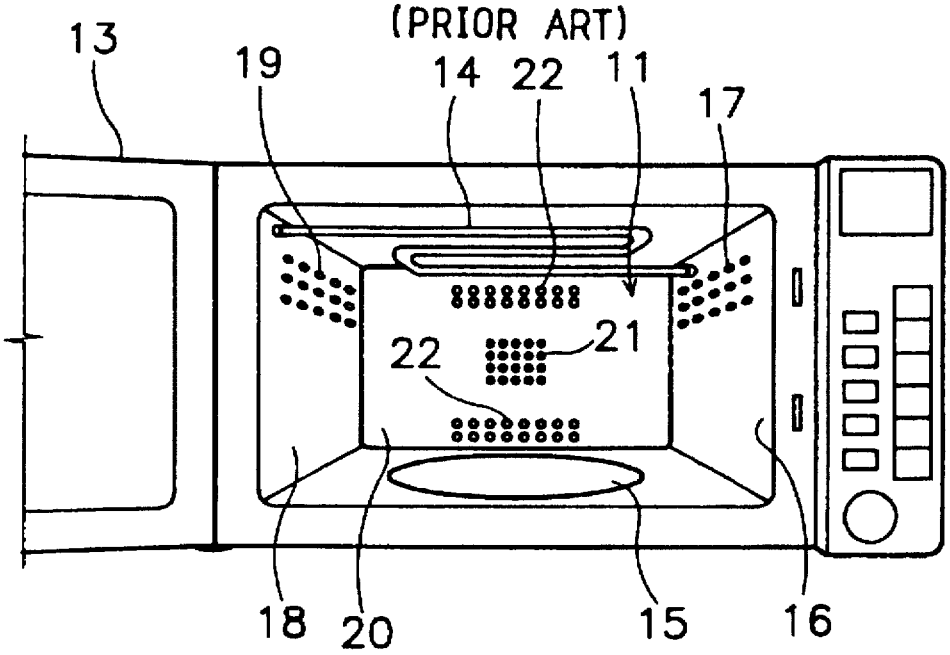
FIG. 4A (PRIOR ART)
Figure 4B:
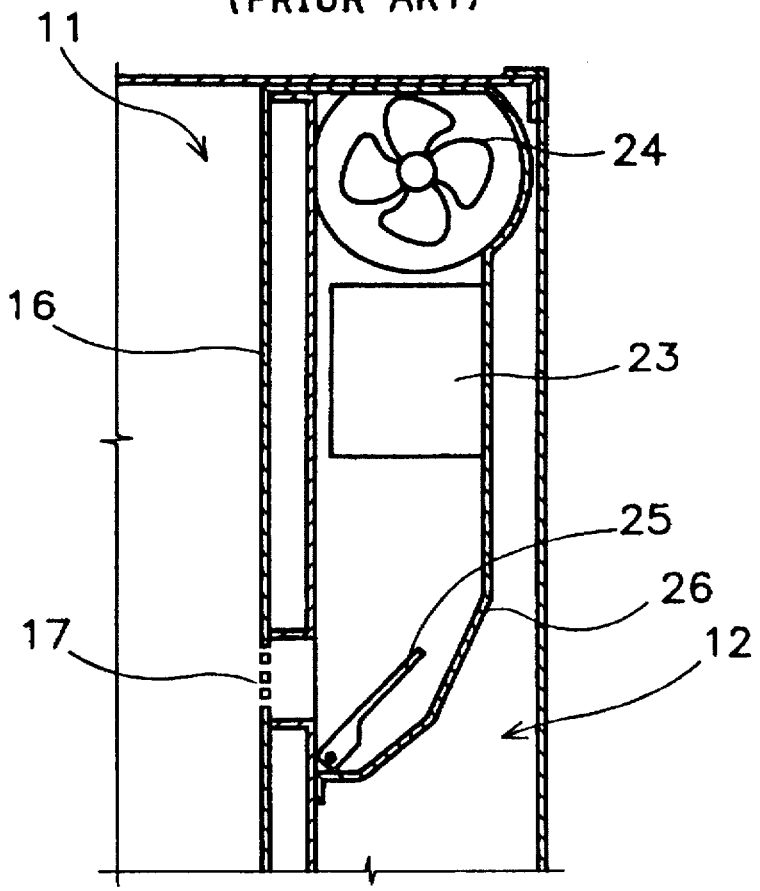
FIG. 4B (PRIOR ART)

FIG. 3 is a transverse sectional view of the convection microwave oven according to this invention, which depict a schematic construction and arrangement of the hot air discharging means 100, which forms a characteristic part of this invention. As shown in the figure, the protecting cover 53, in which the hot air discharging means 100 is mounted, is fitted to the back side of the main body 50 which includes the cooking chamber 54 and the electrical component compartment 55. As mentioned above, the hot air-suction and discharge holes 58,59 are formed on the lower portion and upper portion of the rear wall 57 of the cooking chamber 54, respectively.

The hot air discharging means 100 comprises a driving motor 101 and a fan 102, a connecting shaft 103 connecting the driving motor 101 and the fan 102, and a bracket 104 supporting the driving motor 101. The bracket 104 is fitted to a supporting plate 105 arranged in the protecting cover 53. Between the supporting plate 105 and the rear wall 57 are arranged the electric heater 56, as well as the connecting shaft 103 and the fan 102.

The connecting shaft 103 is directed toward the air-inflow holes 61 which are formed on the side wall 60 partitioning the cooking chamber 54 and the electrical component compartment 55 to each other. For this arrangement, the bracket 104 is configured so as to support the driving motor 101 such that the shaft 103 is aimed generally toward the air-inflow holes 61. By such a construction, the fan 102, connected to the driving motor 101 by the connecting shaft 103, can discharge the hot air toward the air-inflow holes 61, so that an air curtain is formed which can prevent an inflow of the outside air through the air-inflow holes 61. It is preferred that the fan 102 is of an axial type which discharges air in the axial direction.

The operation of a convection microwave oven according to this invention will be described below.

The cooking method by a convection microwave oven is largely divided into one option of utilizing microwave energy, which is an essential function of a microwave oven, and the other option of utilizing convection and radiation energy by means of the electric heater 56 and the fan 102.

For the cooking process by the microwave energy, when the user pushes a start button after choosing the cooking method and time etc., a high voltage is supplied to the magnetron 71 from the high voltage transformer 69, and then microwaves from the magnetron 71 are emitted toward a foodstuff in the cooking chamber 54. Due to the microwave energy, molecules consisting of the foodstuff move at high speeds and it causes friction heat, so that the foodstuff is cooked by such a principal cooking method of a microwave oven. At the same time, the fan 68 in the electrical component compartment 55 operates to draw the outside air therein, so that the electrical components such as the high voltage transformer 69 and the magnetron 71 etc. are cooled.

The outside air passing through the electrical components is guided by the guide duct 72, a portion of which is directed to the cooking chamber 54 through the air-inflow holes 61, and the other of which is discharged outside through the bypass passage 73. Vapor generated in the cooking chamber 54 becomes entrained in the air drawn in the cooking chamber 54 and flows away to the outside through the air-discharge holes 63.

On the other hand, where a foodstuff like meat or fish is cooked by the convection cooking method, the electric heater 56 in the protecting cover 53 radiates heat and the fan 102 is operated by the driving motor 101. So the air in the cooking chamber 54 is drawn into the protecting cover 53 through the hot air-suction holes 58 and turns into hot air, and then discharged again into the cooking chamber 54 through the hot air-discharge holes 59, thereby cooking the foodstuff placed on the tray 64. Even in the convection cooking mode, the microwave cooking mode by the magnetron 71 can be used to evenly cook the inside of the foodstuff. Accordingly, the cooling fan 68 must be operated to cool the electrical components in the electrical component compartment 55.

After the drawn outside air, as described above, passes through the electrical components to be cooled, a portion of the air goes toward the air-inflow holes 61 formed on the side wall 60 of the cooking chamber 54, and the remaining air flows away to the outside through the bypass passage 73.

At this time, hot air is forced by the fan 102 toward the air-inflow holes 61 to form an air curtain across the holes 61, so that the outside air, drawn into the electrical component compartment 55 by the cooling fan 68, does not enter the cooking chamber 54 through the air-inflow holes 61. Therefore, the inside of the cooking chamber 54 can be kept at a high temperature by the electric heater 56 without inflow of the outside air, thereby preventing unnecessary heat loss.

As can be understood from the above description, because the convection microwave oven according to this invention does not require a damper for preventing the inflow of the outside air nor any driving means or control means for closing/opening a damper, the convection microwave oven according to this invention has advantages in that the assembling work can be simplified, and a lighter weight of the product and decreased costs can be accomplished.

What is claimed is:

1. An oven capable of microwave cooking and simultaneous microwave/convection cooking, comprising:

a main body including a cooking chamber, and an electrical component compartment separated from one another by a partition wall having through-holes therein;

a magnetron and high voltage transformer mounted in said compartment for supplying microwaves to said chamber for performing microwave cooking;

an electric heater for supplying heat to air employed in said cooking chamber for performing convection cooking during the simultaneous microwave/convection cooking;

a first air circulator operable during both microwave cooking and simultaneous microwave/convection cooking and arranged for drawing outside cooling air into said compartment for cooling said magnetron and high voltage transformer; and a second air circulator operable during the simultaneous microwave convection cooking and arranged for directing heated air toward said through-holes in said partition wall from the cooking chamber side of said through-holes to form an air curtain across said through-holes opposing the travel of cooling air through said through-holes and into said cooking chamber.

2. The oven according to claim 1 wherein said heater and said second air circulator are disposed in a space behind said cooking chamber, said space communicating with said cooking chamber by holes disposed in a wall separating said cooking chamber from said space, said second air circulator arranged to direct air toward said holes in said wall.

3. The oven according to claim 2 further including a bracket disposed in said spaces; said second air circulator including a driving motor mounted on said bracket, a shaft driven by said motor, and a fan mounted on said shaft.

4. The oven according to claim 1 further including a guide duct mounted in said compartment; said guide duct including an inlet for receiving cooling air from said first air circulator, and two outlets; one of said outlets communicating with said holes in said partition wall, and the other outlet conducting air from said compartment in by-passing relationship to said cooking chamber.

5. The oven according to claim 1 wherein each of said first and second air circulators comprises a fan.

* * * * *